US005761598A

United States Patent [19]

Kazakos et al.

[11] Patent Number: 5,761,598

[45] Date of Patent: Jun. 2, 1998

[54] COMPOSITION FOR A CERAMIC COATED DETONING ROLL FOR USE IN AN ELECTROSTATOGRAPHIC CLEANING APPARATUS

[75] Inventors: Ann M. Kazakos; Michael J. Duggan, both of Webster, N.Y.

[73] Assignee: Xerox Corporation, Stamford, Conn.

[21] Appl. No.: 786,541

[22] Filed: Jan. 21, 1997

[51] Int. Cl.[6] ..... G03G 21/00

[52] U.S. Cl. ..... 399/349

[58] Field of Search ..... 399/349, 284, 399/357, 353, 354, 264; 15/256.5, 256.51, 256.52; 492/28, 60

[56] References Cited

U.S. PATENT DOCUMENTS

| | | | |
|---|---|---|---|
| 4,494,863 | 1/1985 | Laing | 399/354 |
| 5,182,601 | 1/1993 | Hodoshima et al. | 399/264 X |
| 5,241,343 | 8/1993 | Nishio | 399/357 X |
| 5,322,970 | 6/1994 | Behe et al. | 399/279 |
| 5,384,627 | 1/1995 | Behe et al. | 399/291 |
| 5,473,418 | 12/1995 | Kazakos et al. | 399/284 |

*Primary Examiner*—S. Lee

*Attorney, Agent, or Firm*—Tallam I. Nguti

[57] ABSTRACT

A detoning roll having a ceramic outer coating for removing residual toner particles from a cleaning reproduction machine. The ceramic outer coating consists essentially of a suitable mixture of alumina and titania by weight giving the detoning roll a desired resistivity within a range of $2.8\times10^{7}$–$2.10\times10^{9}$ (Ohm-cm), a discharge time constant of greater than 600 microseconds, and a dielectric constant within a range of 12–24 at 100 KHz.

7 Claims, 4 Drawing Sheets

COMPOSITION FOR A CERAMIC COATED DETONING ROLL FOR USE IN AN ELECTROSTATOGRAPHIC CLEANING APPARATUS

BACKGROUND OF THE INVENTION

This invention relates generally to electrostatograhic reproduction machines, and more particularly concerns a composition for a ceramic coated detoning roll for use in a cleaning apparatus of such machines.

Electrostatographic reproduction machines, such as xerographic printers and copiers, conventionally each have a cleaner or cleaning apparatus that uses an aluminum detoning roll with an approximately 50 micron anodized surface. The electrical properties of a detoning roll ordinarily are required to produce a dielectric constant sufficient to support a cleaning field electrical bias. It is usually intended that the anodized aluminum detoning roll last the life of the machine. However, some cleaners have shown that the rolls are wearing out prior to the machine life, requiring replacement of the entire cleaner. Based on field data, it has been estimated that a cleaner will have to be replaced at least twice during the life of the machine which can be very expensive.

The following disclosures may be relevant to various aspects of the present invention and may be briefly summarized as follows:

U.S. Pat. No. 5,384,627 to Behe et al. discloses a developer unit adapted to develop a latent image with toner particles. The unit includes a housing defining a chamber for storing a supply of toner particles in the chamber. The unit also includes a donor roll with a circumferential surface having a conductivity less than $10^{-8}$ (ohm-cm)$^{-1}$ and having a central region and opposed marginal regions. The donor roll is spaced from the latent image to form a development zone. The unit further includes an electrode member which is positioned in the development zone adjacent opposed marginal regions and spaced from the central regions of the donor roll. The electrode member is electrically biased to detach toner particles from the donor roll to form a toner powder cloud in the development zone with toner particles from the toner cloud developing the latent image.

U.S. Pat. No. 5,322,970 to Behe et al. discloses a donor roll for the conveyance of toner in a development system for an electrophotographic printer. The donor roll includes an outer surface of ceramic. The ceramic has a suitable conductivity to facilitate a discharge time constant thereon of less than 600 microseconds. The donor roll is used in conjunction with an electrode structure as used in scavengeless development.

SUMMARY OF INVENTION

In accordance with the present invention, there is provided a detoning roll for use in a cleaning apparatus of an electrostatographic reproduction machine to remove residual toner particles from an imaging member. The detoning roll includes a conductive core; and a ceramic outer coating over the conductive core. The ceramic coating consists essentially of a mixture of alumina and titania by weight, for giving the detoning roll a desired resistivity within a range of $2.8\times10^{7}$–$2.10\times10^{9}$ (Ohm-cm), and a discharge time constant of about 600 microseconds.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
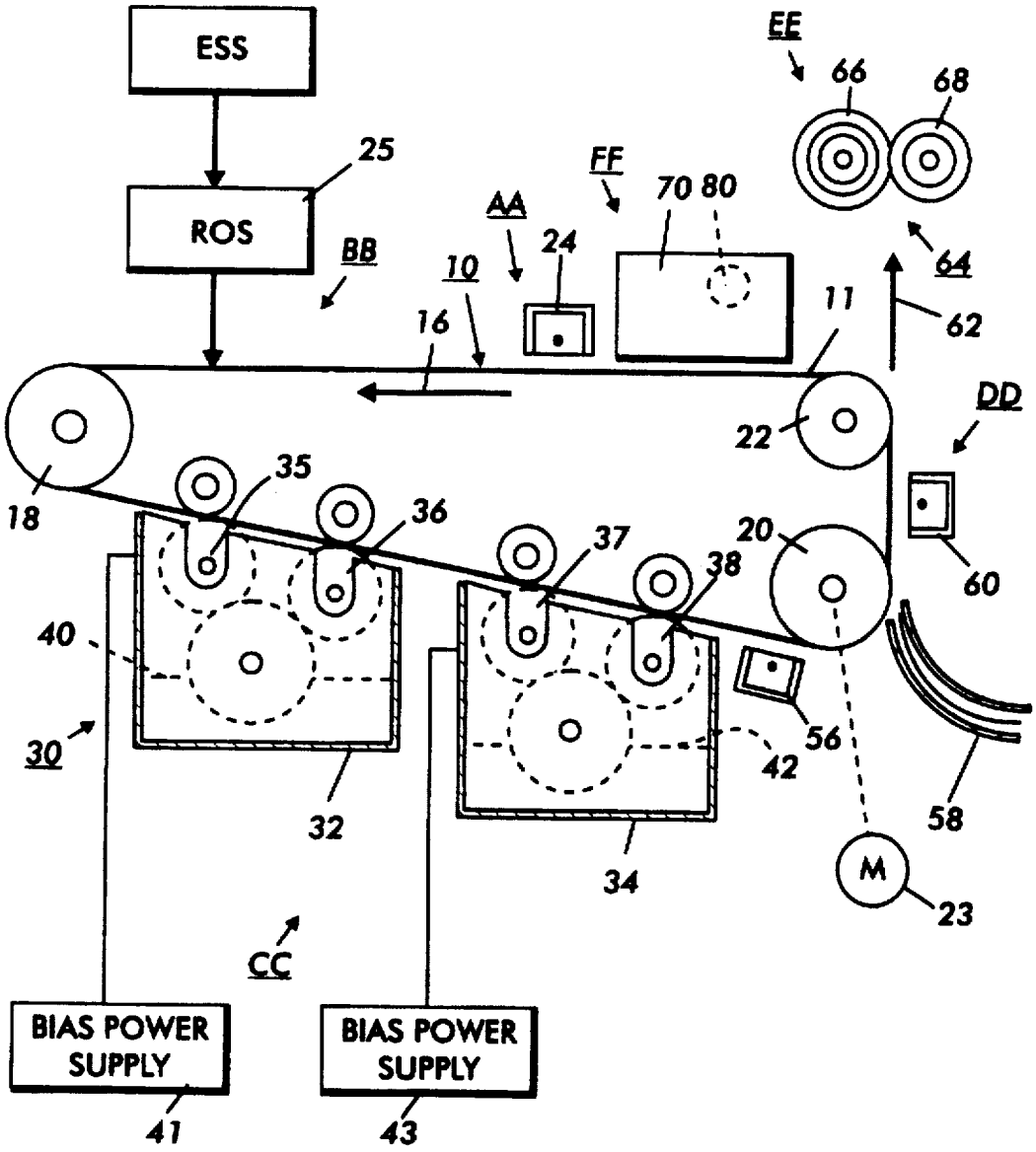
FIG. 4 is a schematic illustration of an electrostatographic reproduction machine incorporating the cleaning apparatus and detoning roll of the present invention.

Referring now to the drawings, where the showings are for the purpose of describing a preferred embodiment of the invention and not for limiting same, and where the various processing stations employed in a reproduction machine as illustrated in FIG. 4, will be described only briefly.

Referring now to FIG. 4, a reproduction machine, in which the present invention finds advantageous use, utilizes a charge retentive image bearing member in the form of a photoconductive belt 10 consisting of a photoconductive surface 11 and an electrically conductive, light transmissive substrate mounted for movement past a charging station AA, an exposure station BB, developer stations CC, transfer station DD, fusing station EE and cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Roller 20 is coupled to motor 23 by suitable means such as a belt drive. Motor 23 rotates roller 20 to advance belt 10 in the direction of arrow 16.

As can be seen by further reference to FIG. 4, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station BB. At exposure station BB, the uniformly charged photoreceptor or charge retentive surface 10 is exposed to a laser based input and/or output scanning device 25 which causes the charge retentive surface to be discharged in accordance with the output from the scanning device. The scanning device is a three level laser Raster Output Scanner (ROS). The resulting photoreceptor contains both charged-area images and discharged-area images.

At development station CC, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 to fusing station EE.

Fusing station EE includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet. After fusing, copy sheets are directed to catch tray, not shown or a finishing station for binding, stapling, collating etc., and removal from the machine by the operator.

Residual toner and debris remaining on photoreceptor belt 10 after each copy is made, are removed at cleaning station FF with a cleaning apparatus 70 including a ceramic coated detoning roll 80 of the present invention.

Figure 1:
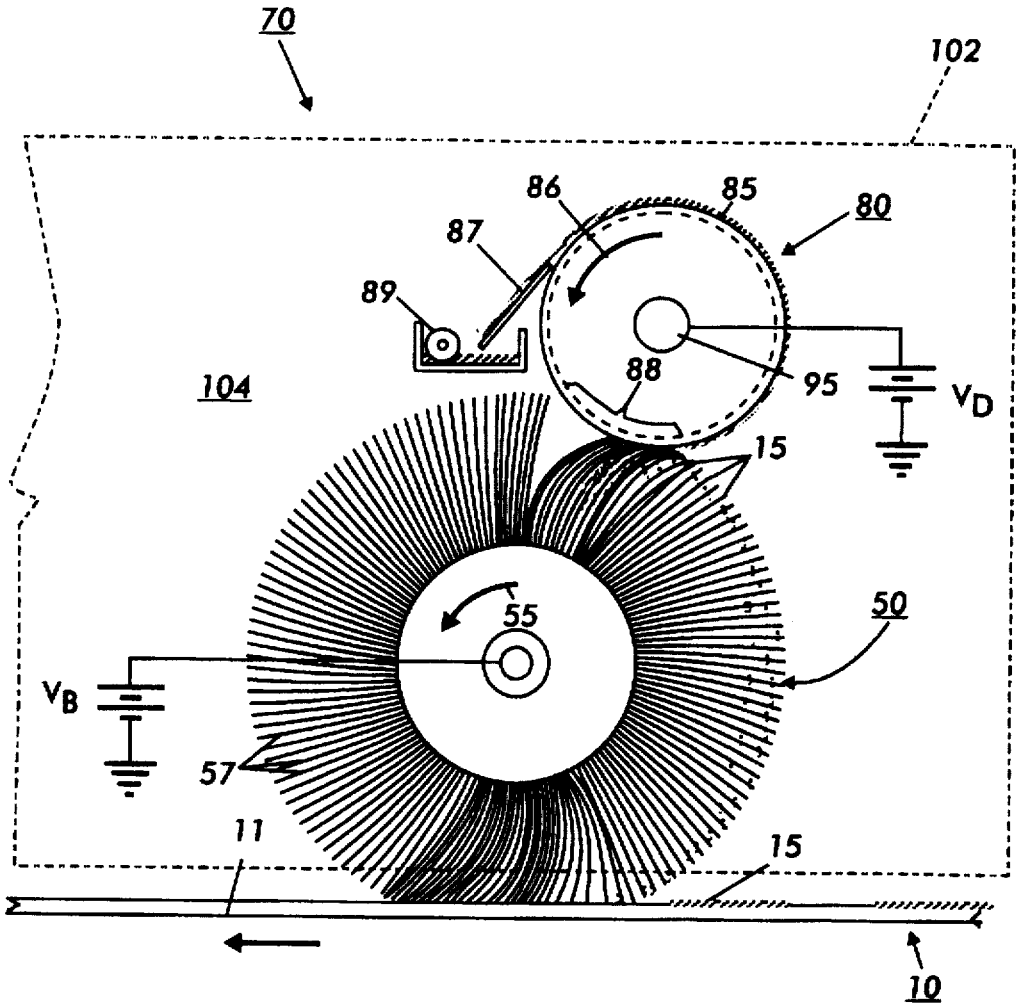
FIG. 1 is an elevational schematic view of aa electrostatographic cleaning apparatus including the detoning roll of the present invention.

Referring now to FIG. 1, the cleaning apparatus 70 of the present invention is illustrated in detail, and is suitable for removing residual toner particles 15 from the surface 11 of an image bearing member 10 of an electrostatographic reproduction machine. The cleaning apparatus 70 includes a housing 102 defining a cleaning chamber 104. A cleaning member 50, such as a brush, is mounted within the chamber and includes fibers 57 that are positioned into cleaning contact with the image bearing surface 11. The cleaning member or brush 50 is electrically biased by a cleaning field source $V_B$ and is moved rotatably in the direction of the arrow 55 for removing residual toner particles 15 from the image bearing surface 11, and for entraining and moving such particles 15 within the fibers 57.

Importantly, the cleaning apparatus 70 includes a rotatable detoning roll 80 of the present invention that is connected to a biasing source $V_D$. As illustrated, the detoning roll 80 is rotatable in the direction of arrow 86, and is mounted within the chamber 104 so as to form a detoning nip 88 with the fibers 57 of the cleaning member or brush 50 for detoning or receiving entrained toner particles 15 from the fibers 57.

As further shown, the cleaning apparatus 70 includes a scraper blade 87 for removing the residual toner particles 15 from the detoning roll 80. A take-away system including an auger 89 is provided for taking the residual toner particles out of the housing 102. The scraper blade 87 may be made of a urethane material or of stainless steel, depending on the surface finish of the detoning roll 80.

According to the present invention, a urethane blade 87 is preferred when the surface finish of the ceramic coated roll 80 is basically unfinished, that is, basically left in an "as-sprayed condition" at about 3 microns. The relatively high roughness of the unfinished ceramic surface as such operates to reduce the actual area of contact between the detoning roll and a cleaning edge of the scraper blade, thus reducing blade drag during cleaning. For stainless steel blades 87, the as-sprayed ceramic coating of about 3 microns is diamond ground to a surface finish within 0.43 to 1.0 micron, in order similarly to reduce blade drag during cleaning.

Figure 2:
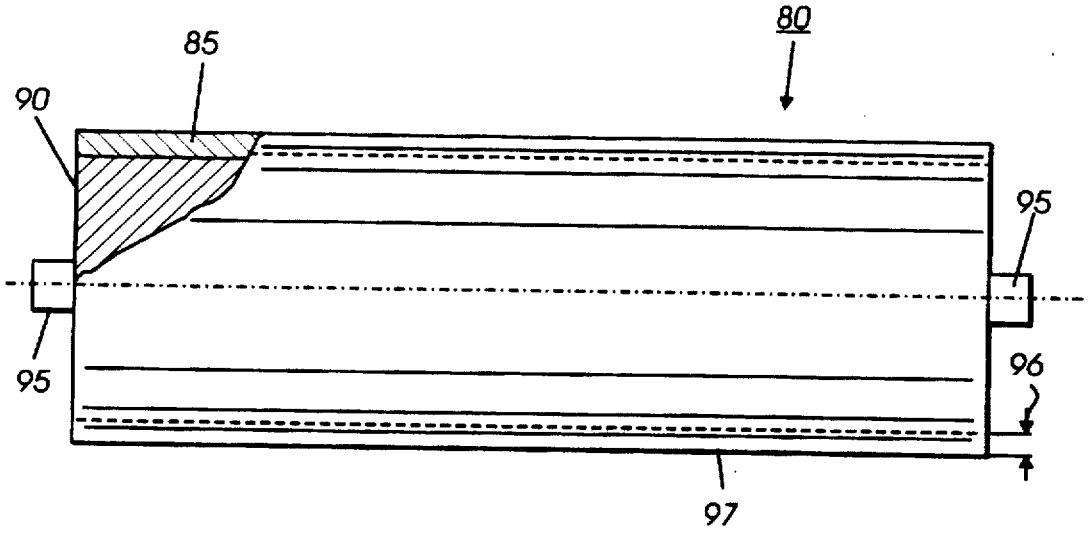
FIG. 2 is a plan view of an embodiment of the detoning roll of the present invention.

Referring now to FIGS. 1 and 2, the ceramic coated detoning roll 80 of the present invention includes a core 95, an electrically conductive substrate 90, and a ceramic outer coating 85 that is formed over the conductive substrate 90 and has a thickness 96 and a desired surface finish 97. As shown, the ceramic detoning roll 80 has a generally cylindrical elongated shape. The electrically conductive substrate 90 may be made of any suitable conductive material, such as aluminum, and may be fabricated by any suitable method such as by machining or by extruding.

In accordance with the primary aspect of the present invention, the outer layer 85 preferably is made of a particular advantageous ceramic compound or composition (to be described in detail below). Ceramic is ordinarily a non-metallic, inorganic compound normally comprised of a blend of any of a number of materials including for example the following: alumina, zirconia, thoria, beryllia, magnesia, spinel, silica, titania, and forsterite. Ceramics which include at least one of aluminum (Al), boron (B), carbon (C), germanlure (Ge), silicon (Si), titanium (Ti), zirconlure (Zr), magnesium (Mg), beryllium (Be) and tungsten (W) are particularly hard, highly abrasion resistive, have high resistivity, and high dielectric strength.

The testing and selection of particular combinations and compositions among the above materials for meeting cost, process, and the cleaning process requirements of an electrostatographic process, clearly would appear unpredictable and time consuming.

Generally, the use of a detoning roll coated with a ceramic compound is disclosed, for example, in U.S. application Ser. No. 08/517,024, filed Aug. 18, 1995 and commonly assigned to the assignee of this application. In addition, a similar but different ceramic composition coated roll, (a development donor roll) requiring and having a relatively faster time constant, was disclosed in commonly assigned U.S. Pat. No. 5,473,418 issued Dec. 5, 1995. The contents and disclosures of U.S. Pat. Nos. 5,322,970; 5,473,418; and of U.S. application Ser. No. 08/517,024, are hereby fully incorporated in this application by reference.

The ceramic surface coating or layer 85 of the detoning roll 80 of the present invention is preferably plasma sprayed onto the substrate 90. Initially it should be plasma sprayed to a desired thickness 96 of about 3 microns, so as to be sufficient for achieving required surface finishes as well as cleaning apparatus electrical properties. Plasma spraying as a process generates a plasma by passing an inert gas through a high voltage electric arc. The ionized gas is forced through a nozzle where powder is introduced into the plasma stream. The powder melts and is projected at high velocities onto a substrate. Depending on the particular substrate used it may be necessary to cool the samples with air jets during the plasma spray process.

Because in plasma spraying the ceramic coating 85 can be controlled precisely, it can thus be controlled in order to ensure that surface anomalies such as craters or pin holes are kept to a minimum. The use of a plasma spray method of applying the ceramic coating in addition results in a much more uniform periphery geometry than that obtained from other methods. Thus, grinding subsequent to plasma coating, if not desired, can often be eliminated. A detoning roll 80 having a ceramic coating surface 85 therefore is unlikely to show any significant abrasion problems when used for an extended period of time in a cleaning apparatus, despite moving contact with the bristles of the cleaning brush 50.

Unlike ceramic coated donor rolls used in hybrid-scavengeless development, the ceramic composition for the ceramic coated detoning roll 80 of the present invention is developed so as to have a slower discharge time constant within a range from about 2000 microseconds to 600 microseconds, with a preferred discharge constant of about 1300 microseconds.

According to the present invention specifically, it has been found that a particular combination of ceramic producing materials consisting essentially of alumina and titania in specific ratios, is sufficient to produce a plasma sprayed coating on an aluminum core detoning roll that satisfies the resistivity, dielectric constant, and discharge time constant requirements of the cleaning apparatus of the present invention. Commercially, however, alumina and titania compounds, which are suitable for plasma spray coating applications, are available mainly as pre-formulated powder compounds, such as AT-87 and AT-60 both available from a vendor White Engineering Surfaces Corporation of Newton Pa.

Testing of several batches from this vendor showed one batch of 100% At-87 to be a powder consisting essentially of 87% alumina and 13% titania, by weight. More precise testing of another batch of 100% At-87 showed it to consist of about 88% alumina, 11% titania, and about 1% of other oxides, by weight. Similarly, testing of one batch of 100% At-60 showed it to be a powder consisting essentially of about 60% alumina and about 40% titania, by weight, and more precise testing of another batch of AT-60 showed to consist of about 52% alumina, about 46% titania and about 2% other oxides.

These types of ceramic powders were also selected because they are relatively finer than other possible powders. Using such finer powders produces a final coating that has a-higher theoretical density, and hence no pinholes and voids in order to provide the necessary breakdown voltage protection of greater than 2000 volts, even for a thin coating thereof.

Alumina is an excellent insulator with resistivity values of $10^{-6}$ ohm-cm at room temperature. Pure, stoichiometric titania is also used as an insulator with book values of $10^{13}$ ohm-cm at room temperature. The dielectric constants of alumina and titania are reported at 1 MHz are about 9 and 100, respectively. An important feature of titania is the extent to which it can be chemically reduced when exposed to temperatures in excess of 900° C. The reduction of titania leads to significant changes in electrical conductivity. As the oxygen is lost during the plasma spray process the Ti ions move onto interstitial sites and resistivity decreases.

The particular ceramic composition of the present invention was found by combining an understanding of the temperatures that are generated in the plasma spray process and knowledge of the ability to reduce titania at high temperatures as above, thereby controlling the electrical conductivity of the resultant coating to within the desired range.

It has also been found that detoning rolls coated with one batch of AT-87 ceramic compound have discharge time constants that were slow, (i.e time constants just greater than 600 microseconds (see FIG. 4)) for detoning roll coating applications. The particular batch of AT-87 was therefore not quite acceptable alone for purposes of the present invention.

On the other hand, detoning rolls coated with one batch of AT-60 ceramic compound, although meeting other requirements, generally had too high a conductivity, and the discharge time constants thereof were relatively too fast for purposes of the present invention.

Through formulation and testing of various ratios of AT-87 and AT-60 (Table 1), in order to arrive at various non-commercially available ratios of alumina and titania, it has been found according to the present invention that detoning rolls coated with a ceramic compound made from 94% AT-87 and 6% AT-60 (indicated by *) and consisting of about 86% alumina (Al2O3) and about 14% titania (TiO2), by weight, effectively and additionally meet the resistivity and discharge time constant requirements for the cleaning apparatus of the present invention.

TABLE 1

| % BY WEIGHT OF AT-87 AND AT-60 | % BY WEIGHT OF EACH CERAMIC MATERIAL |
|---|---|
| 90% AT-87/20% AT-60 | 84% $Al_2O_3$.16% $TiO_2$ |
| 93% AT-87/7% AT-60 | 85% $Al_2O_3$/15% $TiO_2$ |
| 95% AT-87/5% AT-60 | 85.6% $Al_2O_3$/14.4% $TiO_2$ |
| 97% AT-87/3% AT-60 | 86.2% $Al_2O_3$/13.8% $TiO_2$ |
| 100% AT-87 | 87% $Al_2O_3$/13% $TiO_2$ |

Figure 3:
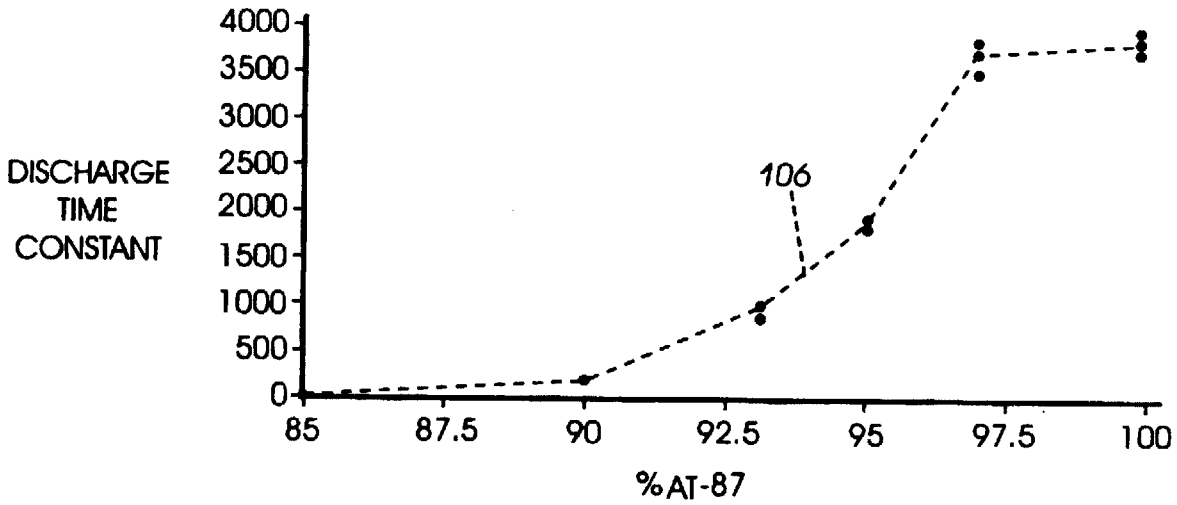
FIG. 3 is a plot of measured discharged time constant values for various percentage compositions obtained as in FIG. 3.

As shown, from Table 1 and FIG. 3 only for examples, the ceramic compound of the present invention preferably should be made from about 94% AT-87 and 6% AT-60 so as to have the desired discharge time constant of greater than 600 microseconds, and can consist of 84%–88% alumina and about 12%–16% titania, by weight depending on application method and equipment. This preferred ratio of the powders chosen for the coating was found by empirical methods. By using fused and crushed, off-the-shelf powders we were able to mix appropriate amounts of two different prepared batches to achieve our coating.

As illustrated in Table 1, this particular ratio was achieved for example by using 94% of a typical batch of AT-87, and about 6% of a typical batch of AT-60 powders from the above mentioned vendor for exhibiting a dielectric strength of 300–600 volts per mil of coating thickness. Other percentages around the 94% and 6% combinations can of course be used, since both powders include alumina and titania. However, in the final composition, it is believed that the percentage of titania of 12%–16% is more critical or more sensitive with respect to the desired resistivity and time constant requirements. Accordingly, the approach will be to seek to achieve this, and then to make up the balance with alumina and the approximately 1–2% other oxides.

FIG. 3 shows a plot of various such ceramic formulation versus oscilloscope measured discharged time constants for each. The preferred range of discharge time constants for the detoning roll 80 of the cleaning apparatus 70 according to the present invention is between 200 and 2000 microseconds, with a preferred value around 1300 microseconds. Note that the discharge time constant for the 94% AT-87 and 6% AT-60 sample shown as 106 is greater than 600 microseconds, and is about 1300 microseconds. This value of discharge time constant is obtained for rolls coated with a composition having a dielectric constant within a range of 12–24 at 100 KHz, and a resistivity of $2.8\times10^{7}$–$4.2\times10^{8}$ ohm-cm at room temperature. The time above was obtained by monitoring a decay of a 100 volt pulse impressed on the coated roll using an oscilloscope.

The particular preferred ratio of 94% AT-87 and 6% AT-60 powders was prepared for plasma spraying by a method that blends appropriate amounts of the required powders, and melts or fuses them together. The powders are then crushed, milled, and sieved before plasma spraying.

It is, therefore, apparent that there has been provided in accordance with the present invention, a ceramic coated detoning roll having a ceramic composition and surface finish that fully satisfy the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A detoning roll for use in a cleaning apparatus of an electrostatographic reproduction machine to remove residual toner particles from an imaging member, the detoning roll comprising:

(a) a conductive core; and (b) a ceramic outer coating formed over said conductive core, said ceramic outer coating consisting essentially of a mixture of alumina and titania by weight for giving the detoning roll a desired resistivity within a range of $2.8\times10^{7}$–$2.10\times10^{9}$ (Ohm-cm), and a discharge time constant of greater than 600 microseconds, said ceramic outer coating comprising essentially about 84–87% alumina and about 12–16% titania by weight, and exhibiting a dielectric strength within a range of 300–600 volts per mil of coating thickness.

2. The detoning roll of claim 1, wherein said mixture of alumina and titania by weight gives said detoning roll a dielectric constant within a range of 12–24 at 100 Khz and a discharge time constant of about 1300 microseconds.

3. The detoning roll of claim 1, wherein said ceramic outer coating has a breakdown voltage of at least 2000 volts.

4. A cleaning apparatus for removing residual toner particles from an image bearing surface of an electrostatographic reproduction machine, the cleaning apparatus comprising:

(a) a housing defining a cleaning chamber;

(b) a cleaning member mounted within said chamber into cleaning contact with the image bearing surface for removing, and entraining, residual toner particles, from the image bearing surface; and (c) a rotatable detoning roll mounted within said chamber forming a detoning nip with said cleaning member for receiving entrained toner particles from said cleaning member, said detoning roll including:

(i) a conductive core; and (ii) a ceramic outer coating consisting of 84%–87% alumina ($Al_2O_3$) and 12%–16% titania ($TiO_2$), by weight, and exhibiting a dielectric strength within a range of 300–600 volts per mil of coating thickness.

5. The cleaning apparatus of claim 4, including electrical biasing sources connected to said cleaning member and to said detoning roll for creating toner removing and receiving fields.

6. The cleaning apparatus of claim 5, wherein said cleaning member is a rotatable brush having fibers for removing and entraining toner particles.

7. An electrostatographic reproduction machine comprising:

(a) an imaging member having an image bearing surface;

(b) means for electrostatically forming a latent image on said image bearing surface; and (c) a development apparatus for developing the latent image with toner particles to form a toner image;

(d) means for transferring the toner image from the image bearing surface to a receiver sheet; and (e) a cleaning apparatus for removing residual toner particles from the image bearing surface, said cleaning apparatus including:

(i) a housing defining a cleaning chamber;

(ii) a cleaning member mounted within said chamber and into cleaning contact with the image bearing surface for removing and entraining residual toner particles, from the image bearing surface; and (iii) a rotatable detoning roll mounted within said chamber and forming a detoning nip with said cleaning member for receiving entrained toner particles from said cleaning member, said detoning roll having a conductive core, and a ceramic outer coating consisting of 84%–87% alumina ($Al_2O_3$) and 12%–16% titania ($TiO_2$), by weight said ceramic outer coating exhibiting a dielectric strength within a range of 300–600 volts per mil of coating thickness.

* * * * *